US009428858B2

(12) United States Patent
Cavallin

(10) Patent No.: US 9,428,858 B2
(45) Date of Patent: Aug. 30, 2016

(54) WIRE ROPE AND METHOD OF CONSTRUCTING WIRE ROPE

(71) Applicant: 1735729 Alberta Ltd., Edmonton (CA)

(72) Inventor: Kim Cavallin, Edmonton (CA)

(73) Assignee: 1735729 Alberta Ltd., Edmonton (CA)

( * ) Notice: Subject to any disclaimer, the term of this patent is extended or adjusted under 35 U.S.C. 154(b) by 141 days.

(21) Appl. No.: 14/213,739

(22) Filed: Mar. 14, 2014

(65) Prior Publication Data

US 2014/0260174 A1 Sep. 18, 2014

Related U.S. Application Data

(60) Provisional application No. 61/836,030, filed on Jun. 17, 2013, provisional application No. 61/805,325, filed on Mar. 26, 2013, provisional application No. 61/791,276, filed on Mar. 15, 2013.

(51) Int. Cl.
*D07B 1/06* (2006.01)
*D07B 5/00* (2006.01)

(52) U.S. Cl.
CPC ..... *D07B 1/0686* (2013.01); *D07B 5/007* (2013.01); *D07B 2201/102* (2013.01); *D07B 2201/203* (2013.01); *D07B 2201/2028* (2013.01); *D07B 2201/2037* (2013.01); *D07B 2201/2048* (2013.01); *D07B 2201/2061* (2013.01)

(58) Field of Classification Search
CPC .... D07B 1/06; D07B 1/0673; D07B 1/0686; D07B 5/007
USPC ..... 57/212, 218, 219, 231
See application file for complete search history.

(56) References Cited

U.S. PATENT DOCUMENTS 3,130,536 A * 4/1964 Peterson ..... D07B 1/068 29/456
3,822,542 A * 7/1974 Naud ..... D07B 1/068 57/215
4,454,708 A * 6/1984 Verreet ..... D07B 1/0673 57/215
4,778,246 A * 10/1988 Carroll ..... D07B 1/068 174/115
4,936,647 A * 6/1990 Carroll ..... D07B 1/068 174/128.1
5,133,121 A * 7/1992 Birbeck ..... H01B 13/0285 174/126.1

(Continued)

FOREIGN PATENT DOCUMENTS

WO 2004/083517 A1 9/2004

OTHER PUBLICATIONS

"Eurolift by Casar®," © 2006-2010 Temiskaming Industrial Mining Equipment Ltd., <http://timeltd.ca/products/hoisting-lifting/wire-rope/eurolift-casar> [retrieved May 23, 2012], 3 pages.

(Continued)

*Primary Examiner* — Shaun R Hurley
(74) *Attorney, Agent, or Firm* — Christensen O'Connor Johnson Kindness PLLC

(57) ABSTRACT

A method of constructing a wire rope from plural outer strands and a core, the core having one or more core strands, each of the one or more core strands having plural core wires, the method comprising: swaging the core to laterally compress the core to an extent sufficient to cause concave deformation of at least some of the plural core wires; and closing the plural outer strands over the core to produce the wire rope.

16 Claims, 3 Drawing Sheets

(56) References Cited

U.S. PATENT DOCUMENTS

| | | | | | |
|---|---|---|---|---|---|
| 5,260,516 | A * | 11/1993 | Blackmore | H01B 5/08 | 174/113 A |
| 5,496,969 | A * | 3/1996 | Blackmore | H01B 5/08 | 174/113 A |
| 5,946,898 | A * | 9/1999 | Kurata | D07B 1/0686 | 57/210 |
| 2007/0062174 | A1 * | 3/2007 | Clough | D07B 1/068 | 57/212 |
| 2012/0085077 | A1 * | 4/2012 | Pourladian | D07B 1/144 | 57/214 |

OTHER PUBLICATIONS

"Swaging," Wikipedia, The Free Encyclopedia, Feb. 13, 2012, <http://en.wikipedia.org/wiki/Swaging> [retrieved Feb. 23, 2012], 8 pages.

"Wire Rope Users Manual," 4th ed., © 2005 Wire Rope Technical Board, Alexandria, Va., 25 pages.

"Wire Rope Construction," excerpt of images believed to have been taken from "Wire Rope Users Manual," © 2005 Wire Rope Technical Board, Alexandria, Va., 1 page.

* cited by examiner

WIRE ROPE AND METHOD OF CONSTRUCTING WIRE ROPE

CROSS-REFERENCE TO RELATED APPLICATIONS

This application claims the benefit under 35 U.S.C. §119(e) of U.S. Provisional Patent Application No. 61/791,276, filed Mar. 15, 2013, U.S. Provisional Patent Application No. 61/805,325, filed Mar. 26, 2013, and U.S. Provisional Patent Application No. 61/836,030, filed Jun. 17, 2013, all of which are incorporated by reference herein in their entirety.

TECHNICAL FIELD

This document relates to wire ropes and methods of constructing wire ropes.

BACKGROUND

Wire ropes are used in a variety of industrial applications. A wire rope is a type of rope with strands of metal or steel wire laid or twisted into a helix around a core. This core can be one of three types. The first is a fiber core, made up of synthetic or natural material. Fiber cores are the most flexible and elastic, but are easily crushed and thus not suitable for heavy loads. The second type, wire strand core, is made up of one additional strand of wire, and is typically used for suspension. The third type is independent wire rope core, which is the most durable in all types of environments. Such ropes are suitable for running ropes.

Processes exist that are designed to improve the qualities of a wire rope. For example, it is known to swage or compact a wire rope after closing the outer strands over the core, or to swage or compact the outer strands before closing the rope. It is also known to flatten the outside of a wire rope core to allow an outer strand to contact two or more wires of the core strands at once, thus preventing the outer strand from being displaced into the space between the core strands under a heavy load.

SUMMARY

A method is disclosed of constructing a wire rope from plural outer strands and a core, the core having one or more core strands, each of the one or more core strands having plural core wires, the method comprising: swaging the core to laterally compress the core to an extent sufficient to cause concave deformation of at least some of the plural core wires; and closing the plural outer strands over the core to produce the wire rope.

A wire rope is also disclosed comprising: an independently swaged core having one or more core strands, each of the one or more core strands having plural core wires, in which at least some of the plural core wires have a concave deformity; and plural outer strands closed over the core.

A method is also disclosed of constructing a wire rope from plural outer strands and a core, the core having one or more core strands, each of the one or more core strands having plural core wires, the method comprising: hammering the core with one or more dies to laterally compress the core; and closing the plural outer strands over the core to produce the wire rope.

In various embodiments, there may be included any one or more of the following features: The wire rope is also swaged. The wire rope is a running rope. Swaging is done to an extent sufficient to cause concave nicking between respective wires of adjacent core strands of the one or more core strands. Swaging is done to an extent sufficient to cause lateral displacement between adjacent core wires of at least some of the plural core wires. The core consists essentially of metal components, for example steel components. The core comprises one or more non-metal components. Non-metal components comprise one or more of fiber strands, fiber wires, polymer strands, polymer wires, lubricating oil, polymer, adhesive, filler, and a coating. Respective wires, of adjacent core strands of at least some of the one or more core strands, are concavely nicked. Adjacent core wires of at least some of the plural core wires are laterally displaced from one another. Prior to swaging the core, compacting one or more core strands, the core, or one or more core strands and the core. Prior to swaging the core, one or more core strands are compacted by swaging.

These and other aspects of the device and method are set out in the claims, which are incorporated here by reference.

BRIEF DESCRIPTION OF THE FIGURES

Embodiments will now be described with reference to the figures, not drawn to scale, in which like reference characters denote like elements, by way of example, and in which.

DETAILED DESCRIPTION

Immaterial modifications may be made to the embodiments described here without departing from what is covered by the claims.

Figure 1:
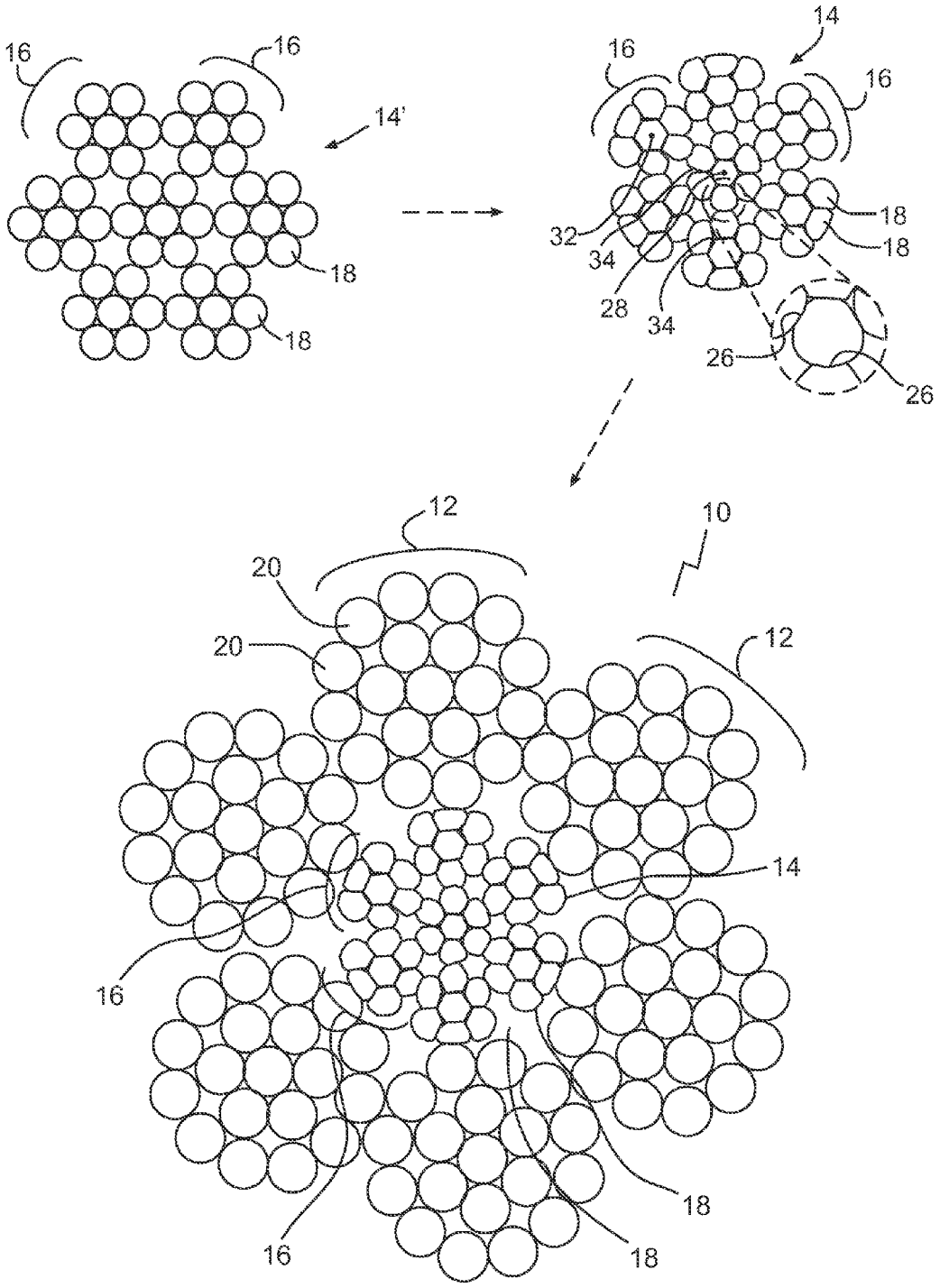
FIG. 1 is a flow diagram illustrating a method of constructing a wire rope according to the embodiments disclosed herein.

Referring to FIG. 1, a wire rope 10 is made from plural outer strands 12 and a core 14, which may also be referred to as an independent wire rope core. The core 14 has one or more core strands 16, with each of the one or more core strands 16 having plural core wires 18. Each of the outer strands 12 may have plural wires 20.

Strands are assemblies of individual wires. Wires are normally made of non-alloy carbon steel although other suitable materials may be used such as steel, iron, stainless steel, monel, and bronze materials. Wires may be made by suitable methods, such as the drawing process where the wire cross-section is reduced in stages, for example in seven stages from 6 mm to 2 mm diameter. By the drawing process, the nominal strength of the wire may be increased.

Wires in strands may be laid in various arrangements for various purposes. In cross lay strands, the wires of the different layers cross each other. In parallel lay strands, the lay length of all the wire layers may be equal and the wires of any two superimposed layers may be parallel, resulting in linear contact. These wires are neighbors along the whole length of the strand. Parallel lay strands may be made in one operation. The endurance of wire ropes with parallel lay strands is greater than of those of cross lay strands.

Strands with one or more wire layers may have the construction of filler wire, Seale, Warrington, or other constructions. Combinations of these constructions may be used in a strand. Strand classifications may indicate the number of strands as well as the number of wires in each strand, for example 6×7, 6×19, 6×36, 8×19, 19×7, and 35×7. Other suitable numbers of strands and wires may be used. Thus, although the example shown in FIG. 1 illustrates a 7×7 core 14 closed with 6×19 outer strands 12, other configurations may be used. In addition, other suitable numbers of outer strands 12, such as 8 or 10 strands, may be used, as well as other suitable numbers of core strands 16. Within each strand, other suitable numbers of wires may be used.

Wire ropes may have one or more strand layer over the core. Outer strands may be helically laid in various orientations about a core. The lay direction of the strands in the rope may be right or left and the lay direction of the wires in each strand may be right or left. Ordinary lay rope refers to the situation where the lay direction of the wires in the outer strands is in the opposite direction as the lay of the outer strands themselves. If both the wires in the outer strands and the outer strands themselves have the same lay direction, the rope is referred to as a Lang Lay rope (formerly Albert's lay or Lang's lay). Lang lay rope may be more abrasion resistant and flexible than ordinary lay rope. Strands may have more than one lay type, for example if strands alternate between lay types. Multi-strand wire ropes may be more or less resistant to rotation and may have at least two layers of outer strands laid helically around a core. The direction of the outer strands may be opposite to that of the underlying strand layers.

Wire ropes may be used for various industrial applications. For example, running ropes may be bent over sheaves and drums. Running ropes are stressed by bending and tension, although excessive loads can lead to crushing of the rope on the drum itself. In contrast to running ropes, track ropes may not take on the curvature of the rollers. Under roller force, a free bending radius of the rope may occur. This radius increases and the bending stresses decrease with the tensile force and decreases with the roller force. Wire rope slings may be used to harness various kinds of goods. These slings are stressed by the tensile forces but first of all by bending stresses when bent over the edges of the goods.

Wire ropes may be stressed by fluctuating forces, by wear, by corrosion and in some cases by extreme forces. Rope life is finite and safe usage requires periodic inspection of the wire rope to detect wire breaks on a reference rope length, cross-section loss as well as other indicia of failure so that the wire rope can be replaced before a dangerous situation occurs. Installations may be designed to facilitate the inspection of the wire ropes. Many installations require combinations of methods to increase the safety of the wire rope. For example, lifting installations for passenger transportation may use a combination of several methods to prevent a load from plunging downwards. Elevators may have redundant bearing ropes and a safety gear. Ropeways and mine hoistings may be permanently supervised by a manager and the rope may be inspected regularly to detect inner wire breaks.

Swaging is a forging process in which the dimensions of an item are altered using a die or dies, through which the rope is forced. Swaging is usually a cold working process but may be done as a hot working process. Swaging includes rotary swaging (FIG. 3) where one or more dies 22 are used to hammer a strand or rope into a smaller diameter. Swaging is normally the method of choice for metals since there is no loss of material in the process. It is possible to achieve greater diameter reductions with swaging instead of compacting by pulling through a die. Other swaging methods may be used.

As indicated above, it is known to swage a wire rope after closing the outer strands over the core. Swaging the wire rope in this fashion reduces wire rope diameter. However, the core of the wire rope is less impacted by the swaging than are the outer strands, as only the outer strands are directly hammered. Thus, cores of wire ropes swaged in such a fashion may have increased resistance to drum crushing but may still experience such crushing under heavy loads. It may not be possible to swage large diameter wire ropes at all as the wire rope may be too large to fit into a swaging machine. A larger diameter swaging machine may not exist or be present on site.

Figure 3:
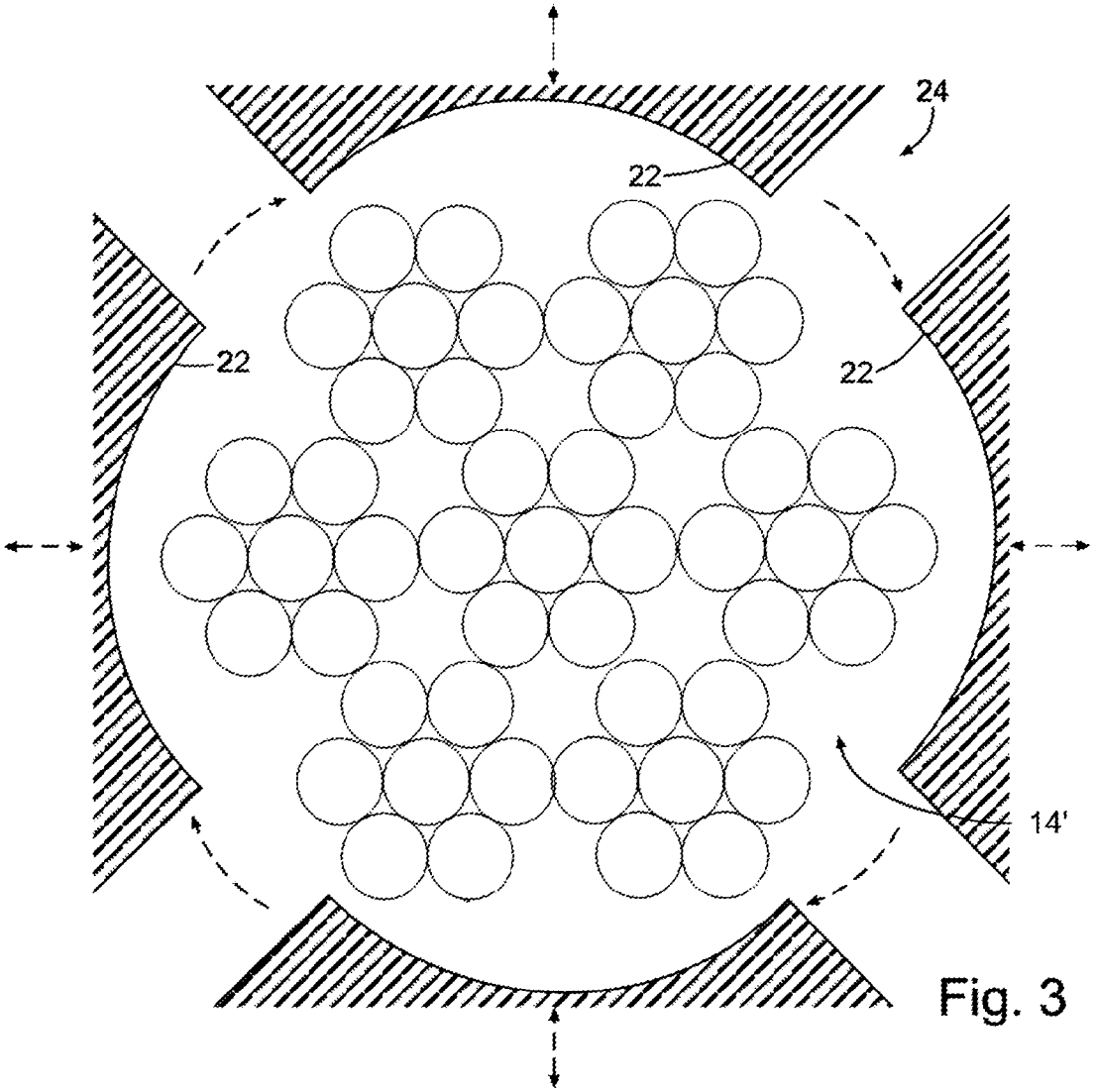
FIG. 3 is a cross-sectional view of a wire rope core positioned in an exemplary rotary swaging apparatus.

Referring to FIGS. 1 and 3, a method of constructing a wire rope 10 is illustrated. In a first stage, the core 14' is swaged to produce a swaged core 14. Swaging the core 14' has been found to impart strength and resistance to core failure to the finished wire rope 10. As shown, the outer core wires may be flattened by swaging, thus reducing the occurrence of outer strand wires contacting two core wires at once. The flattening of outer core wires reduces wire to wire abrasion between the core and outer strands, and other forms of damage. Swaging the core is also advantageous when the diameter of the wire rope itself is too large to be swaged.

FIG. 3 illustrates a swaging process that may be used. In the example shown, the core 14' is hammered, for example with dies 22 to laterally compress the core 14' to the swaged core 14 shown in FIG. 1. A suitable number of dies 22 may be used, for example two, three, four, or more. As discussed above, hammering occurs with rotary swaging and may include rotating the dies 22 about the core 14' as the process is occurring. Swaging may compress the core 14 to a greater extent than regular compacting. Swaging may also impart assymetric deformation as defined in a cross sectional plane perpendicular to a core axis 28.

The extent of diameter reduction from swaging depends on various factors such as the radius of curvature of the dies 22, the force applied by the dies 22, the density of the wires, and the pore space concentration in the pre-swaged core 14'. The larger the diameter reduction, the fewer the voids, the higher the metallic cross-sectional concentration, and the lower the pore space concentration in the swaged core. Thus, for example, if the diameter of core 14, which has an initial pore space of 40%, is reduced by 10% the pore space drops to 25%. A 20% diameter decrease results in pore space of 5%.

Swaging may be carried out to an extent sufficient to laterally compress the core 14' and cause concave deformation in the swaged core 14 of at least some of the plural core wires 18 (FIG. 1). Concave deformations are evidenced by the concave closed path cross sectional profile of a wire as shown. The close up of the swaged core 14 illustrates many concave deformations 26. Concave deformations 26 are defined in cross sectional planes perpendicular to a core axis 28. Concave deformations increase contact surface area between adjacent wires 18 and strands 16. In addition, the reduction in pore space and increase in metallic cross sectional concentration increase the strength of the core beyond what is possible with swaging of the outer strands only. In general, concave deformities are evidence of the type of crushing force exerted by the swaging process used to produce strong, failure-resistant cores 14.

Figure 4:
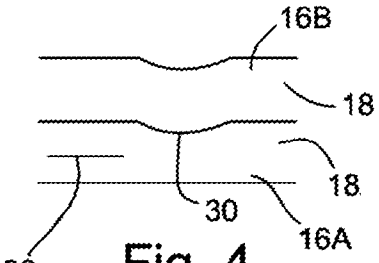
FIG. 4 is a side elevation view of a nicked wire of one strand adjacent a wire of a second strand.

Referring to FIG. 4, swaging may be done to an extent sufficient to cause concave nicking between respective wires of adjacent core strands of the one or more core strands. Thus, in the example shown a nick 30 is formed in core strand 16A adjacent core strand 16B. Such nicking is defined in cross sectional planes parallel to a strand axis 32 of a strand 16. Nicking in this manner may further increase contact surface area between adjacent wires.

Figure 5:
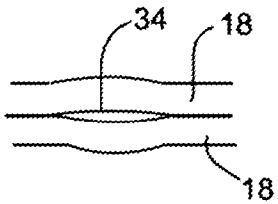
FIG. 5 is a top plan view of a pair of wires that have been laterally displaced from one another.

Referring to FIGS. 1 and 5, swaging may be done to an extent sufficient to cause lateral displacement between adjacent core wires 18 of at least some of the plural core wires. Adjacent core wires 18 are understood to be positioned in the same core strand 16, although lateral displacement may also occur between respective wires of adjacent strands. Lateral displacement is generally a sign of weakness in a wire rope, due to a reduced contact surface area at lateral displacement points 34. However, it has been found that the increased strength and resistance to core failure of the resulting wire rope 10 outweighs such defects. Thus, the presence of lateral displacement points 34 may be viewed as evidence that the swaging was carried out aggressively enough to achieve strength improvement. Lateral displacement may be defined in cross sectional planes parallel to a strand axis 32 or perpendicular to core axis 28.

Figure 2:
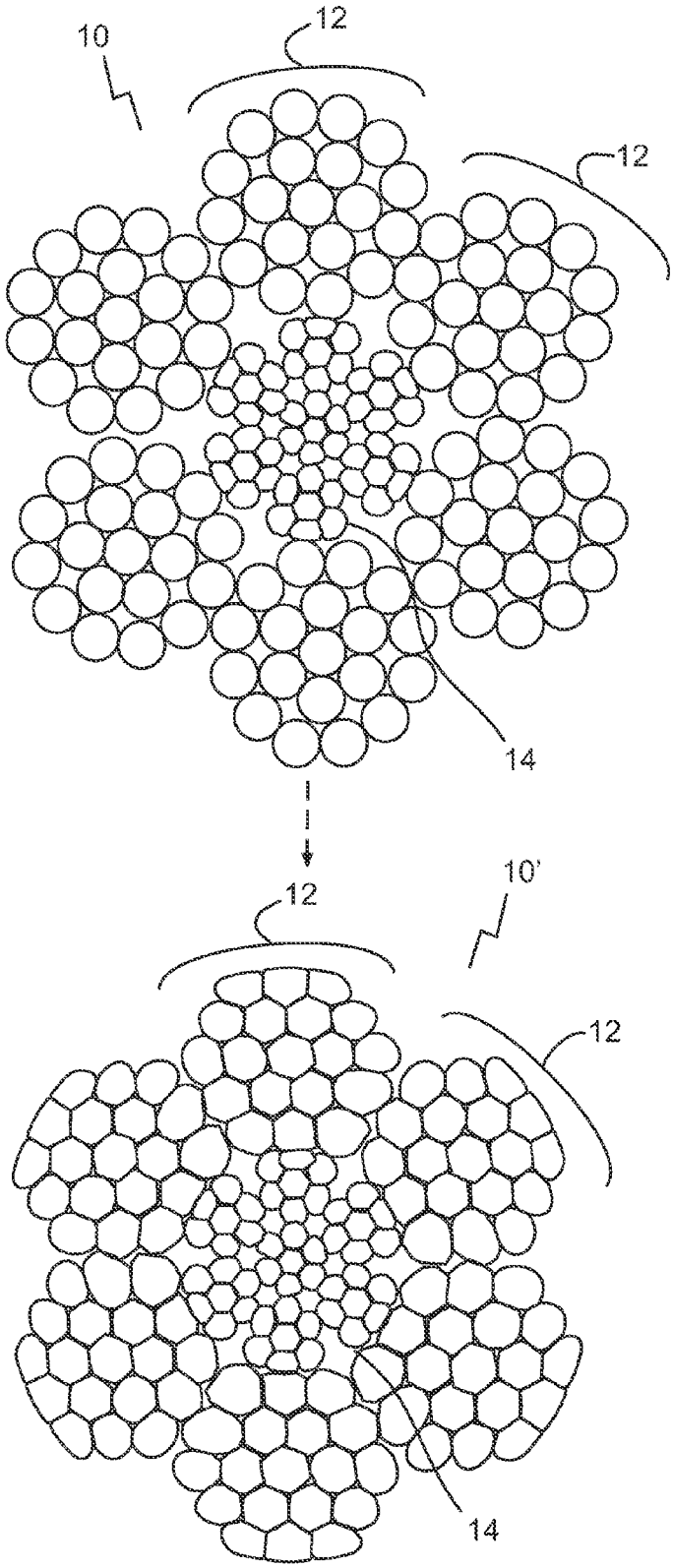
FIG. 2 is a flow diagram illustrating a further method of constructing a wire rope according to the embodiments described herein.

Referring to FIGS. 1 and 2, after passing the core 14' through the swaging apparatus 24, the swaged core 14 is ready for the outer strands 12. Thus, in the next stage the plural outer strands 12 are closed over the core to produce the wire rope 10. Suitable outer strands 12 and lay configurations may be used.

In another stage, the closed wire rope 10 may be swaged further to produce wire rope 10' (FIG. 2). Swaging the wire rope 10 imparts further strength to the finished wire rope 10', by reducing pore density, reducing diameter, increasing contact surface area between components, densifying the wire rope 10' and increasing metallic cross sectional concentration.

A wire rope with 8 outer strands 12 will have a core size to outer strand size ratio that is larger than in a wire rope with 6 outer strands. Thus, the more outer strands in a wire rope the greater the relative load taken by the core, and the greater the significance of having an increased strength core 14.

In some cases the core 14 consists essentially of metal components. Thus, no structural fillers such as fiber, polymer, or rubber may be found in such an example, as such fillers tend to weaken the core relative to the use of all metal components. Non-metal structural components such as rubber or fiber fillers or wires tend to get destroyed during swaging. Nominal amounts of non structural non metal materials such as lubricating oil, polymer, adhesive or other suitable materials may still be present. In other embodiments, non metal structural components may be present, for example fiber or plastic strands or wires, or coatings, including coatings formed by plastic impregnation of the core.

In some embodiments, the core 14, one or more core strands 16, or the core 14 and one or more core strands 16 may be compacted prior to swaging of the core 14. In some embodiments, one or more core strands 16 may be swaged prior to swaging of the core 14.

The methods disclosed herein may impart various degrees of physical degradation to the wire rope. For example, the resulting wire rope may be stiffer, less flexible, and more brittle than a comparable wire rope with only the outer strands swaged. In addition, the internal wires may be degraded, for example by lateral concavination, lateral displacement, and nicking as discussed above. Such degradation may occur within the inner core strand or strands as well as the outer core strands. However, such physical degradation is outweighed by the increased strength and resistance to core failure of wire rope produced by the disclosed methods.

As stated, the core 14 has one or more core strands 16. In some cases, the core 14 has one, two, or more layers of core strands 16.

As discussed above, the wire ropes disclosed herein may be used in various applications such as use as running ropes. The wire ropes may be used in mining, for example as mining shovel lines or drag lines, where the wire rope will experience extremely heavy loads, vibration, and fatigue. The wire ropes may be configured to reduce or prevent rotation on loading, for example if the inside and outside strands are wound in opposite directions. The wire ropes disclosed herein may also be used in other suitable applications.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method of constructing a wire rope from plural outer strands and a core, the core having one or more core strands, each of the one or more core strands having plural core wires, the method comprising:

swaging the core to laterally compress the core to an extent sufficient to cause concave deformation of at least some of the plural core wires; and closing the plural outer strands over the core to produce the wire rope.

2. The method of claim 1 further comprising swaging the wire rope.

3. The method of claim 1 in which the wire rope is a running rope.

4. The method of claim 1 in which swaging is done to an extent sufficient to cause concave nicking between respective wires of adjacent core strands of the one or more core strands.

5. The method of claim 1 in which swaging is done to an extent sufficient to cause lateral displacement between adjacent core wires of at least some of the plural core wires.

6. The method of claim 1 in which the core consists essentially of metal components.

7. The method of claim 1 in which the core comprises one or more non-metal components.

8. The method of claim 7 in which non-metal components comprise one or more of fiber strands, fiber wires, polymer strands, polymer wires, lubricating oil, polymer, adhesive, filler, and a coating.

9. The method of claim 1 further comprising, prior to swaging the core, compacting one or more core strands, the core, or one or more core strands and the core.

10. The method of claim 7 in which prior to swaging the core, one or more core strands are compacted by swaging.

11. A wire rope comprising:

an independently swaged core having one or more core strands, each of the one or more core strands having plural core wires, in which at least some of the plural core wires have a concave deformity; and plural outer strands closed over the core.

12. The wire rope of claim 11 in which the wire rope is swaged.

13. The wire rope of claim 11 in which respective wires, of adjacent core strands of at least some of the one or more core strands, are concavely nicked.

14. The wire rope of claim 11 in which adjacent core wires of at least some of the plural core wires are laterally displaced from one another.

15. The wire rope of claim 11 in which the core consists essentially of metal components.

16. A method of constructing a wire rope from plural outer strands and a core, the core having one or more core strands, each of the one or more core strands having plural core wires, the method comprising:

swaging the core to laterally compress the core to an extent sufficient to cause deformation and lateral displacement between adjacent core wires of at least some of the plural core wires; and closing the plural outer strands over the core to produce the wire rope.

* * * * *